US005898947A

United States Patent [19]

Page

[11] Patent Number: 5,898,947

[45] Date of Patent: May 4, 1999

[54] TAKEUP DEVICE FOR A FIREFIGHTER GARMENT

[75] Inventor: Roger A. Page, Londonderry, N.H.

[73] Assignee: Globe Manufacturing Co., Pittsfield, N.H.

[21] Appl. No.: 08/888,696

[22] Filed: Jul. 7, 1997

[51] Int. Cl.[6] ..... A41D 1/06

[52] U.S. Cl. ..... 2/237; 2/221; 24/302

[58] Field of Search ..... 2/221, 237, 220, 2/236; 24/301, 302

[56] References Cited

U.S. PATENT DOCUMENTS 1,081,611 12/1913 Hazard ..... 2/237

5,566,397 10/1996 Scott ..... 2/237

*Primary Examiner*—Diana L. Biefeld

*Attorney, Agent, or Firm*—Watson Cole Grindle Watson P.L.L.C.

[57] ABSTRACT

A first buckle having a slot therethrough is connected to the garment at a first location. One end portion of a takeup strap is connected to the garment at a spaced second location. A second buckle has a pair of slots formed therethrough with a bar therebetween. The takeup strap extends from the second location through a slot in the second buckle, around the bar, through the other slot in the second buckle, through the slot in the first buckle, and the opposite end portion of the takeup strap is connected to the second buckle.

6 Claims, 2 Drawing Sheets

FIG. 2
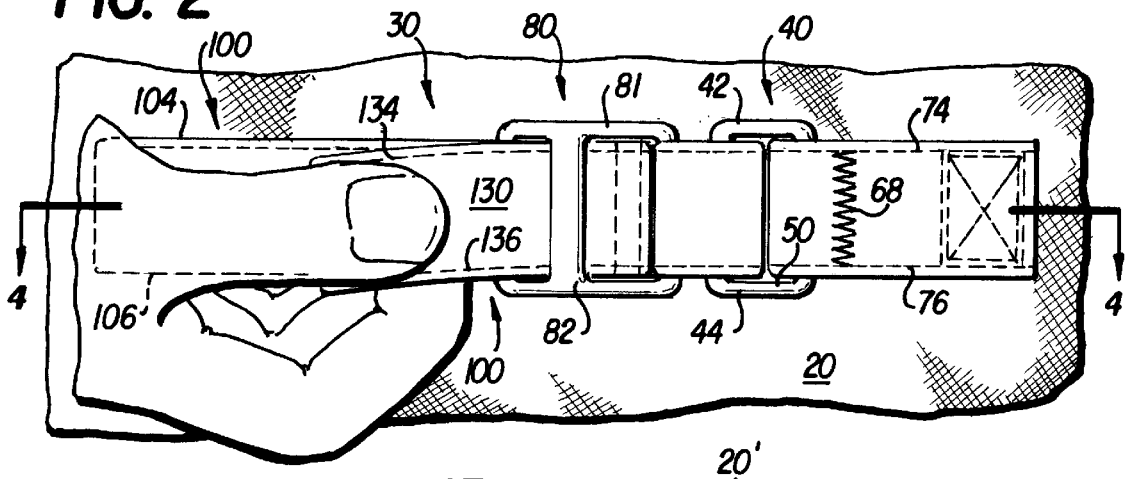
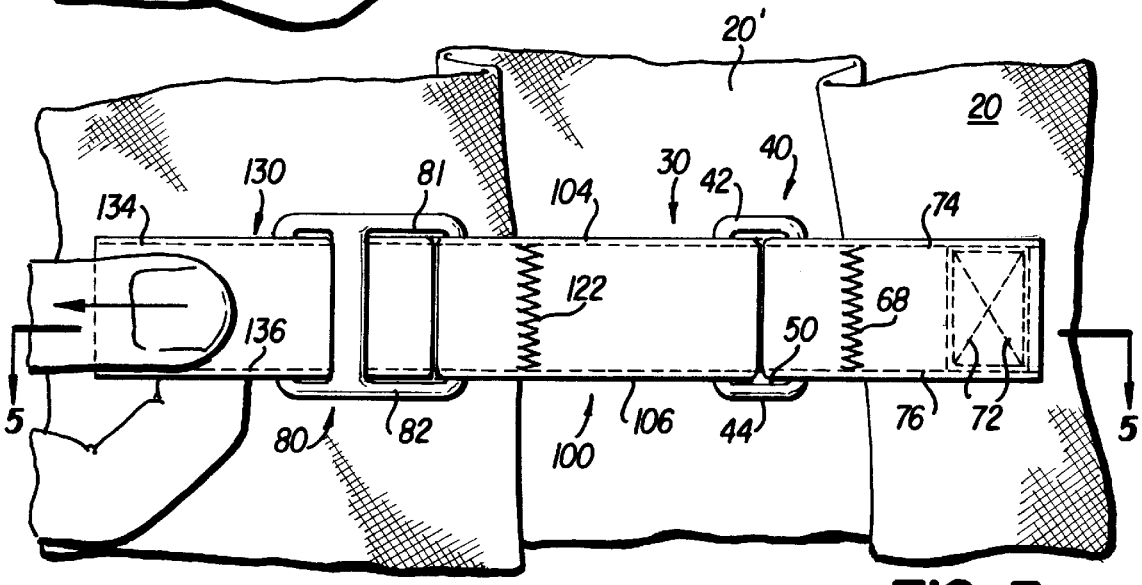
FIG. 3
FIG. 4
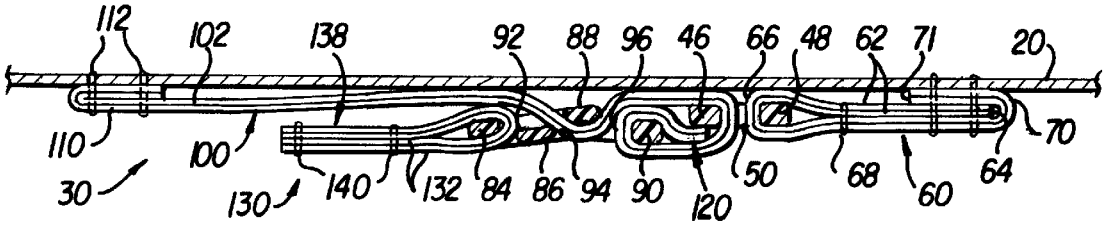
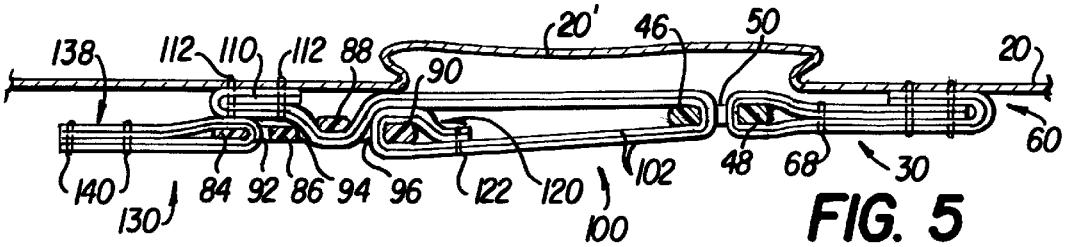
FIG. 5

TAKEUP DEVICE FOR A FIREFIGHTER GARMENT

BACKGROUND OF THE INVENTION

The present invention relates to a takeup device for tightening a firefighter garment about the waist of a firefighter. The takeup device may be used in combination with a pair of firefighter pants or a firefighter jacket. Each of these garments includes a waist portion which must be adjusted from time to time by tightening the garment about the firefighter's body. Accordingly, takeup devices have been provided for tightening the waist portion of such garments. Such prior art takeup devices have generally proved to be unsatisfactory because of difficulty in operating them in the field, and because many of them are constructed similar to aircraft seat belts with loose and dangling ends which are undesirable during firefighting operations.

Since such takeup devices may be operated while under adverse conditions and while a firefighter is wearing gloves, they must be capable of being operated simply by grasping the device and tugging it forwardly relative to the firefighter. In other words, a pair of takeup devices are connected to the garment at the waist portion thereof adjacent the opposite hips of a firefighter. The takeup at the left hip can be gripped by the right hand, and the takeup at the right hip can be gripped by the left hand and pulled forwardly to tighten the waist portion of the garment about the body of a firefighter.

Accordingly, it is a principal objective of the invention to provide a takeup device which can be readily operated and which eliminates any loose or dangling ends.

SUMMARY OF THE INVENTION

The present invention includes a first buckle having a slot formed therethrough and a second buckle having at least a pair of slots formed therethrough with a bar disposed between the slots. The first buckle is connected to the garment at a first location. A takeup strap has a first end portion connected to the garment at a second location spaced from the first location and is threaded through the slots in the second buckle and the slot in the first buckle, with the second end portion connected to the second buckle.

When the takeup device is in its initial position wherein the garment has not been tightened, the two buckles are disposed adjacent to one another and the material of the garment is not gathered. When it is desired to tighten the waist of the garment, the second buckle is manually moved away from the first buckle thereby causing the aforesaid first and second locations to be moved toward one another, causing the material of the garment to be gathered, thereby tightening the waist portion of the garment about the body of the firefighter.

The tension in the garment material as well as the takeup device and the frictional contact of portions of the takeup strap hold the components in adjusted position without any slippage. When the garment is removed, the second buckle can be readily manually moved back to its initial position adjacent the first buckle to enable the garment to expand to its maximum dimension.

The takeup device is a very compact and efficient arrangement which completely eliminates any loose or dangling ends. Only a short fixed length pulltab is provided to facilitate grasping to pull the second buckle away from the first buckle.

DETAILED DESCRIPTION OF THE DRAWINGS

FIG. 2 is an enlarged view of the takeup device shown in FIG. 1 in an initial non-tightened position;

FIG. 3 is a view similar to FIG. 2 showing the takeup device in a tightened position;

FIG. 4 is a sectional view on line 4—4 of FIG. 2; and

FIG. 5 is a sectional view on line 5—5 of FIG. 3.

DESCRIPTION OF THE PREFERRED EMBODIMENT

Figure 1:
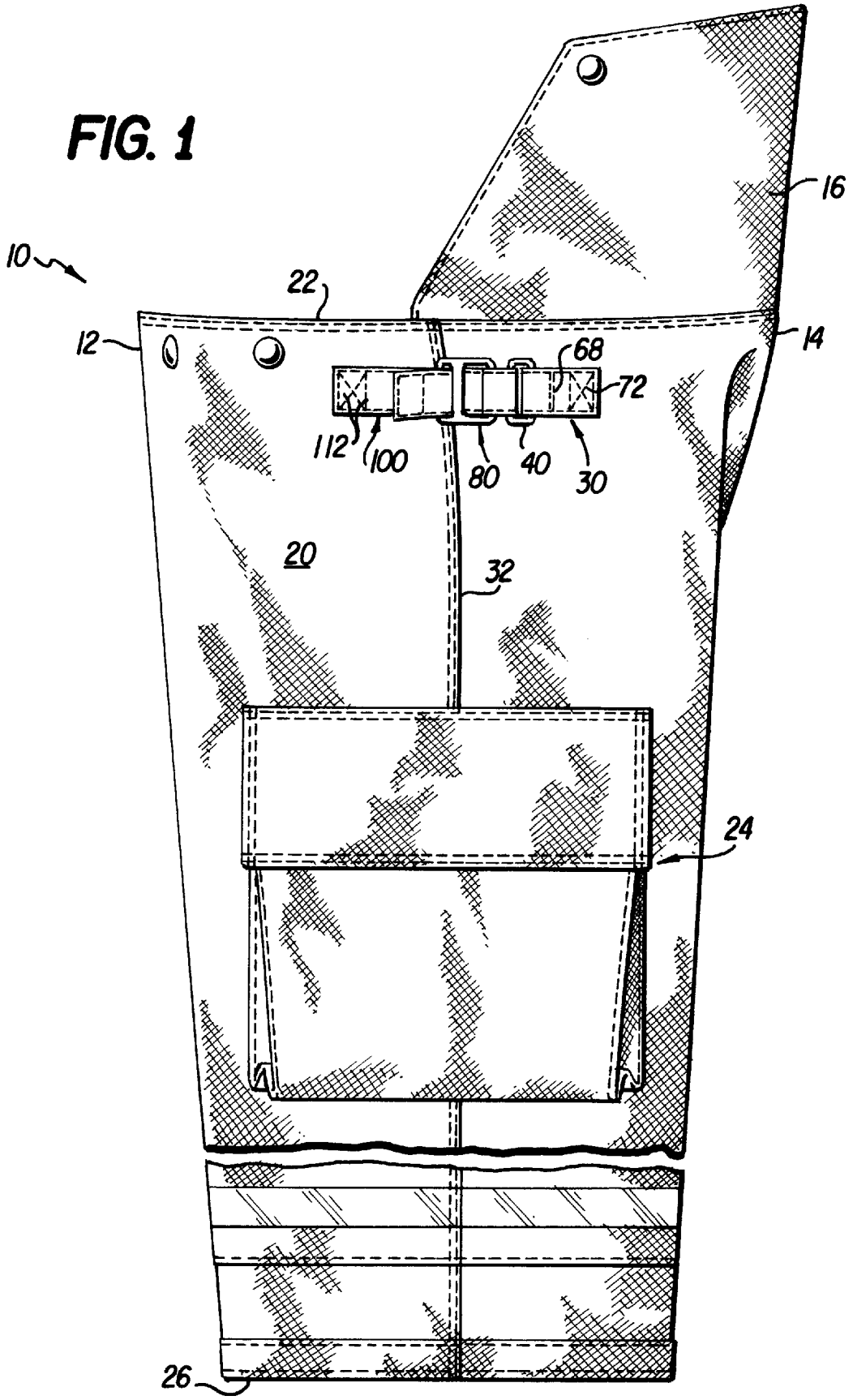
FIG. 1 is a side view, broken away, of a pair of firefighter pants incorporating the invention takeup device.

Referring now to the drawings wherein like reference characters designate corresponding parts throughout the several views, FIG. 1 illustrates a pair of firefighter pants 10 having a front portion 12 and a rear portion 14, a panel 16 extending upwardly from the rear portion 14. The pants include an outer shell 20 formed of conventional flame resistant material. It will be understood that the upper edge 22 of the pants and the portion of the shell immediately below the upper edge define the waist portion of the pants. A pocket 24 is provided on the side of the pants, and each pant leg terminates at a lower edge 26.

The novel takeup of the present invention is indicated generally by reference numeral 30 and is connected to the waist portion at one side of the pants, it being understood that a similar takeup is provided at the opposite side of the pants in a similar location. It is noted that the takeup spans the outseam 32 of the associated pant leg.

While the invention is illustrated as a takeup in combination with a pair of firefighter pants, the novel takeup may also be connected to the waist portion of a firefighter jacket. In either case, the takeup will serve a similar function of tightening the waist portion of the associated firefighter garment about the body of a firefighter.

Referring now to FIGS. 2 and 4, the takeup device is shown in its initial position wherein the associated garment has not been tightened. A first integral buckle 40 formed of a suitable material such as plastic includes upper and lower sides 42 and 44 having a pair of spaced parallel bars 46 and 48 interconnected therewith to provide a slot 50 through the buckle.

Buckle 40 is connected to the shell 20 at a first location by an anchor strap 60 which may be formed of any suitable material, but which is preferably formed by two similar strips 62 of material the same as that of the shell. The two strips of material extend from first ends 64 to a point 66 where the strips are threaded through slot 50 in buckle 40. The strips continue to a point where they are stitched together at 68 then curve around the ends 64 of the strips as indicated by reference numeral 70 to terminate in opposite ends at 71. Stitching 72 secures the anchor strap to the shell 20. Parallel lines of stitching 74 and 76 extend between opposite ends of the strips 62 to secure the edges thereof to one another.

Buckle 40 could also be connected directly to the shell 20, if so desired. In such a case, the anchor strap 60 can be eliminated, and bar 48 can be connected to the shell by rivets or the like.

A second integral buckle 80 formed of a suitable material, such as plastic, may be of the configuration shown in U.S. Pat. No. 4,171,555. This particular buckle is readily available on the open market and includes upper and lower sides 81 and 82 having four spaced parallel bars 84, 86, 88 and 90 interconnected therebetween to define three slots 92, 94 and 96 through the buckle. Although this particular buckle is convenient to use, other buckles may be employed as long as the buckle incorporates at least three bars having two slots formed therebetween, as explained hereinafter.

A takeup strap 100 may be formed of any suitable material, but is preferably formed by two similar strips 102 of material the same as that of the shell. These two strips are connected to one another throughout the length thereof along their side edges by lines of stitching 104 and 106. One end portion 110 of the takeup strap is connected to the shell at a second location by stitching 112. It is noted that the first and second locations on the shell are displaced a substantial distance from one another.

The takeup strap extends from the stitching 112 through slot 94 in buckle 80, thence around bar 88, thence through slot 96 in buckle 80, thence through slot 50 in buckle 40. The opposite end portion 120 of the takeup strap is connected to the second buckle by threading the end portion through slot 96 in buckle 80 and securing the terminal end of end portion 120 to an adjacent portion of the takeup strap by stitching 122. It will be noted that as seen in FIGS. 4 and 5, the opposite end portion 120 of the takeup strap frictionally engages another portion of the takeup strap at slot 96 in buckle 80 for frictionally holding the takeup device in adjusted position when the takeup device is under tension with the garment disposed around the body of a firefighter.

As seen in FIGS. 2 and 4, when the takeup device is in its initial position wherein the garment has not been tightened, buckles 40 and 80 are disposed adjacent one another, and shell 20 has not been gathered. When it is desired to tighten the waist of the garment, buckle 80 is manually moved to the left as seen in FIGS. 2 and 4 to move buckle 80 away from buckle 40, thereby causing the shell to be gathered as indicated at 20' in FIGS. 3 and 5. In order to facilitate such movement of buckle 80, an operating means in the form of a pulltab 130 is connected to buckle 80 and is adapted to be grasped between the thumb and finger of a firefighter as indicated. It is noted that since the takeup device is illustrated as being on the left hip of the pants, the pulltab will be grasped by the right hand of the firefighter.

The pulltab comprises a strap which passes through slot 92 of buckle 80 and may be formed of the same material as the shell. The strap may comprise a pair of strips 132 having lines of stitching 134 and 136 extending along the length thereof to secure the opposite edges of the strips to one another. The opposite ends 138 of the strips are stitched to one another at 140. The pulltab provides a convenient means for grasping even when the firefighter is wearing gloves.

In the event buckle 80 includes only three bars and two slots, thereby eliminating bar 84 and slot 92, the pulltab may extend through slot 94 and engage the portion of the takeup strap passing through slot 94.

Although the present invention has been described in connection with preferred embodiments, it will be appreciated by those skilled in the art that additions, modifications, substitutions and deletions not specifically described may be made without departing from the spirit and scope of the invention defined in the appended claims.

I claim:

1. A takeup device for a firefighter garment comprising a firefighter garment having a waist portion, a first buckle connected to said waist portion at a first location, said first buckle having a slot formed therethrough, a second buckle having a pair of slots formed therethrough with a bar disposed between said slots, and a takeup strap having opposite end portions, one end portion of said takeup strap being connected to said waist portion at a second location spaced from said first location, said takeup strap extending from said second location through one of the slots in said second buckle, thence around said bar, thence through the other of the slots in said second buckle, thence through the slot in said first buckle, the opposite end portion of said takeup strap being connected to said second buckle, and operating means connected to said second buckle for moving said second buckle to tighten the waist portion of said garment about the body of a firefighter.

2. A takeup device as defined in claims 1, wherein said operating means comprises a pulltab which can be readily grasped by a firefighter.

3. A takeup device as defined in clam 2, wherein said second buckle has a third slot formed therethrough, said pulltab comprising a strap passing through said third slot, said strap having opposite end portions secured to one another.

4. A takeup device for a firefighter garment comprising a firefighter garment having a waist portion, a first buckle connected to said waist portion at a first location, said first buckle having a slot formed therethrough, a second buckle having a pair of slots formed therethrough with a bar disposed between said slots, and a takeup strap having opposite end portions, one end portion of said takeup strap being connected to said waist portion at a second location spaced from said first location, said takeup strap extending from said second location through one of the slots in said second buckle, thence around said bar, thence through the other of the slots in said second buckle, thence through the slot in said first buckle, the opposite end portion of said takeup strap being connected to said second buckle, and wherein said first buckle is connected to said waist portion by an anchor strap passing through the slot formed through said first buckle, said anchor strap having opposite end portions secured to said waist portion at said first location.

5. A takeup device for a firefighter garment comprising a firefighter garment having a waist portion, a first buckle connected to said waist portion at a first location, said first buckle having a slot formed therethrough, a second buckle having a pair of slots formed therethrough with a bar disposed between said slots, and a takeup strap having opposite end portions, one end portion of said takeup strap being connected to said waist portion at a second location spaced from said first location, said takeup strap extending from said second location through one of the slots in said second buckle, thence around said bar, thence through the other of the slots in said second buckle, thence through the slot in said first buckle, the opposite end portion of said takeup strap being connected to said second buckle, and wherein the opposite end portion of said takeup strap extends through said other of the slots in the second buckle and includes a terminal end secured to an adjacent portion of the takeup strap.

6. A takeup device as defined in claim 5, wherein the opposite end portion of said takeup strap frictionally engages the portion of said takeup strap which extends through the other of said slots in said second buckle for frictionally holding the takeup device in adjusted position when the takeup device is under tension with said garment disposed around the body of a firefighter.

* * * * *